US005246608A

United States Patent [19]

Reynhout et al.

[11] Patent Number: 5,246,608

[45] Date of Patent: Sep. 21, 1993

[54] HYDROCARBON OIL COMPOSITIONS

[75] Inventors: Marinus J. Reynhout; Henricus P. M. Tomassen, both of Amsterdam, Netherlands

[73] Assignee: Shell Oil Company, Houston, Tex.

[21] Appl. No.: 764,282

[22] Filed: Sep. 23, 1991

[30] Foreign Application Priority Data

Sep. 25, 1990 [NL] Netherlands ..... 9002089

[51] Int. Cl.[5] ..... C10M 145/18; C10L 1/18

[52] U.S. Cl. ..... 252/52 R; 44/436; 44/443; 44/447

[58] Field of Search ..... 252/52 R; 44/436, 443, 44/447

[56] References Cited

U.S. PATENT DOCUMENTS 3,726,653 4/1973 Van Der Meij ..... 44/62

4,473,482 9/1984 Serres et al. ..... 252/52 R

*Primary Examiner*—Ellen M. McAvoy

*Attorney, Agent, or Firm*—James O. Okorafor

[57] ABSTRACT

A hydrocarbon oil composition comprising a paraffinic hydrocarbon oil and as an additive, at least one linear polymer of carbon monoxide with one or more α-olefins having at least 10 carbon atoms per molecule said polymer comprising of substantially alternating monomer units of carbon monoxide and olefins is disclosed. Optionally, the composition may also contain one or more $C_{9+}$ or less olefin polymer comprising of substantially alternating monomer units of carbon monoxide and olefins. This composition has and exhibits improved pour point, cloud point, and cold filter plugging point properties. These polymer additives are novel compounds, and a process for their synthesis is also disclosed.

10 Claims, No Drawings

HYDROCARBON OIL COMPOSITIONS

BACKGROUND OF THE INVENTION

The invention relates to novel hydrocarbon oil compositions containing a hydrocarbon oil and a polymer additive.

Hydrocarbon oils such as gas oils, diesel oils, lubricating oils and crude oils can contain considerable amounts of paraffins. When these oils are stored, transported and used at low temperature, problems can occur as a result of crystallization of these paraffins. In order to minimize these problems, it is customary to add certain polymers to the paraffinic hydrocarbon oils. Very customary for this purpose are high-molecular copolymers of ethylene and vinyl acetate, which are commercially available under various names.

In an investigation by the Applicant concerning the use of polymers as additives in paraffinic hydrocarbon oils for improving the properties of these hydrocarbon oils at low temperature, a class of polymers has been found which have proved to be outstandingly suitable for lowering the pour point (PP), the cloud point (CP) and/or the cold filter plugging point (CFPP) of these oils. Comparison of the performance of these polymers with that of the above-mentioned ethylene/vinyl acetate copolymers shows that the former polymers possess a higher activity than these commercial additives. This means that, in comparison with these commercial additives, the polymers investigated by the Applicant for this purpose give—at equal concentration—a stronger PP, CP and/or CFPP reduction or alternatively that an equal PP, CP and/or CFPP reduction or alternatively that an equal PP, CP and/or CFPP reduction can be obtained at a lower concentration. These polymers are linear polymers of carbon monoxide with one or more $\alpha$-olefins having at least 10 carbon atoms per molecule (below referred to as $C_{10+}\alpha$-olefins) and optionally one or more $C_{9+}$or less olefin polymer comprising of substantially alternating monomer units of carbon monoxide and olefins. A number of the polymers found by the Applicant to be suitable as additives for paraffinic hydrocarbon oils were especially synthesized for this purpose and are novel compounds. These are polymers of carbon monoxide with one or more $C_{10+}\alpha$-olefins, which polymers possess a mean molecular weight, calculated as mean weight ($M_w$), of more than $10^4$. These polymers can be prepared by contacting the monomers, at elevated temperature and pressure and in the presence of a diluent consisting of more than 90%v of an aprotic liquid, with a catalyst composition containing a Group VIII metal and a phosphorous bidentate ligand having the general formula $(R_1R_2P)_2R$, where $R_1$ and $R_2$ represent identical or different optionally polar substituted aliphatic hydrocarbon groups and R a bivalent organic bridging group containing at least two hydrocarbon atoms in the bridge linking the two phosphorous atoms together.

SUMMARY OF THE INVENTION

The present invention relates to novel hydrocarbon oil compositions containing a paraffinic hydrocarbon oil and as an additive, linear polymers of carbon monoxide with one or more $C_{10+}\alpha$-olefins and optionally one or more $C_{9+}$or less olefin polymer comprising of substantially alternating monomer units of carbon monoxide and olefins. The invention further relates to novel polymers of carbon monoxide with one or more $C_{10+}\alpha$-olefins possessing an $M_w$ of more than $10^4$, said polymer comprising of substantially alternating monomer units of carbon monoxide and olefins. Furthermore, the invention relates to a process for the preparation of these novel polymers by contacting the monomers at elevated temperature and pressure and in the presence of a diluent which consists of more than 90%v of an aprotic liquid with a catalyst composition containing a Group VIII metal and a phosphorous bidentate ligand having the general formula $(R_1R_2P)_2R$ wherein R, $R_1$, $R_2$ and P are as previously defined.

DETAILED DESCRIPTION OF THE INVENTION

As paraffinic hydrocarbon oils the low-temperature properties of which can be improved according to the invention, mention may be made inter alia of gas oils, diesel oils, lubricating oils and crude oils. Very favorable results were achieved inter alia with the use of the present polymers in paraffinic gas oils. The molecular weight of the polymers which are suitable to be used in the hydrocarbon oil compositions according to the invention may vary between wide limits. For preference, polymers are used having a mean molecular weight, calculated as mean weight ($M_w$), of between $10^3$ and $10^6$ and in particular of between $10^4$ and $10^5$. The $C_{10+}\alpha$-olefins which are used as monomers in the preparation of the polymers are preferably unbranched. They preferably contain fewer than 40 and in particular fewer than 30 carbon atoms per molecule. The preference for a given molecular weight of the polymers and for a given number of carbon atoms in the $C_{10+}\alpha$-olefins which are used as monomers in their preparation is substantially determined by the nature of the paraffins present in the hydrocarbon oil.

In the preparation of the $C_{10+}$and $C_{9+}$polymers, olefins such as ethylene, propylene, butene-1 and cyclopentene can also be used. For preference, exclusively $C_{10+}\alpha$-olefins are used.

The monomer mixture from which the polymers are prepared may contain one or more $C_{10+}\alpha$-olefins in addition to carbon monoxide. As examples of copolymers with which very favorable results were achieved in paraffinic hydrocarbon oils, mention can be made of a carbon monoxide/n-tetradecene-1 copolymer and a carbon monoxide/n-hexadecene-1 copolymer. As an example of a very suitable terpolymer for the present purpose, mention can be made of a carbon monoxide/n-tetradecene-1/n-octadecene-1 terpolymer. In addition to separate polymers, mixtures of polymers can also be used in the hydrocarbon oil compositions according to the invention. Thus, for example, very favorable results were achieved by using mixtures of a carbon monoxide/n-tetradecene-1 copolymer with a carbon monoxide/hexadecene-1 copolymer in paraffinic hydrocarbon oils.

The quantity of polymer which according to the invention is taken up in the paraffinic hydrocarbon oils can vary between wide limits. For preference, 1–10,000 and in particular 10–1,000 mg of polymer is taken up per kg of hydrocarbon oil. In addition to the present polymers, the hydrocarbon oil compositions according to the invention can also contain other additives such as antioxidants, corrosion inhibitors and metal deactivators.

Linear polymers of carbon monoxide with ethylene and with one or more $\alpha$-olefins having at least three carbon atoms per molecule (below referred to as $C_{3+}\alpha$-olefins) said polymer comprising of substantially alternating monomer units of carbon monoxide and olefins, and which polymers possess an $M_w$ of more than $10^4$ can be prepared at a high reaction rate by contacting the monomers, at elevated temperature and pressure and in the presence of a protic diluent, with a catalyst composition containing a Group VIII metal and a phosphorous bidentate ligand having the general formula $(R_3R_4P)_2R$, wherein $R_3$ and $R_4$ represent identical or different optionally polar substituted aromatic hydrocarbon groups and R has the meaning previously indicated. The above-mentioned preparation method has proved to be less suitable for the preparation of polymers of carbon monoxide with one or more $C_{3+}\alpha$-olefins (that is to say, in the absence of ethylene) in which polymers on the one hand the units originating from carbon monoxide and on the other hand the units originating from the olefins occur in a substantially alternating way. Although, in this manner, polymers of this type such as copolymers of carbon monoxide can be prepared with propylene or with butene-1, nevertheless, this is only possible at a comparatively low reaction rate and with formation of polymers having a comparatively low $M_w$. It has meanwhile been found that in the above-mentioned polymerization of carbon monoxide with one or more $C_{3+}\alpha$-olefins considerably higher reaction rates can be achieved and polymers having a considerably higher $M_w$ can be obtained by replacing in the catalyst composition the phosphorous bidentate ligand having the general formula $(R_3R_4P)_2R$ by a phosphorous bidentate ligand having the general formula $(R_1R_2P)_2R$ wherein R, $R_1$ and $R_2$ have the previously indicated meaning.

As has been elucidated above, regarding the incorporation as additives in paraffinic hydrocarbon oils to improve the properties of these oils at low temperature, there is interest in polymers of the present type based on carbon monoxide with one or more $C_{10+}\alpha$-olefins which polymers possess an $\overline{M}_w$ above $10^4$. The Applicant has performed an investigation into the preparation of these polymers. This investigation showed that in the polymerization of carbon monoxide with a $C_3$ $\alpha$-olefin using a catalyst composition containing a phosphorous bidentate ligand having the general formula $(R_1R_2P)_2R$, and in the presence of a protic diluent, a strong decline in the raction rate and a strong decline in the $M_w$ of the resultant polymers occurs. This decline is influenced by the number of carbon atoms per molecule in the $C_{3+}\alpha$-olefin used as comonomer. Although copolymers having a comparatively high $M_w$ can be prepared in this way at acceptable reaction rates with the use of propylene and butene-1 as comonomer, nevertheless, if for example octene-1 is used as comonomer it becomes extremely difficult to prepare polymers having a high $M_w$ at an acceptable reaction rate. On the basis of the results of the investigation performed by the Applicant, it can be stated that until recently it has not been found possible to prepare in this manner polymers of carbon monoxide with one or more $C_{10+}\alpha$-olefins having an $M_w$ above $10^4$ at an acceptable reaction rate.

Continued investigation by the Applicant on this subject, however, has disclosed that with the application of a catalyst composition containing a Group VIII metal and phosphorous bidentate ligand having the general formula $(R_1R_2P)_2R$, polymers of carbon monoxide with one or more $C_{10+}\alpha$-olefins can be prepared at an acceptable reaction rate, said polymer comprising of substantially alternating monomer units of carbon monoxide and olefins, and possessing an $M_w$ above $10^4$, by performing the polymerization in the presence of a diluent which consists of more than 90%v of an aprotic liquid.

Polymers of carbon monoxide with one or more $C_{10+}$ $\alpha$-olefins said polymer comprising of substantially alternating monomer units of carbon monoxide and olefins, and having an $M_w$ of more than $10^4$ are novel.

As examples of the novel polymers which were prepared by the Applicant, mention may be made of carbon monoxide/n-tetradecene-1 copolymers, carbon monoxide/n-hexadecene-1 copolymers, carbon monoxide/n-octadecene-1 copolymers, carbon monoxide/n-tetra-decene-1/n-hexadecene-1/n-octadecene-1 tetrapolymers, carbon monoxide/n-dodecene-1/n-tetradecene-1/n-hexadecene-1/n-octadecene-1 pentapolymers and polymers of carbon monoxide with a mixture of unbranched $\alpha$-olefins having 20–24 carbon atoms per molecule.

In the preparation of the novel polymers according to the invention, use is made of a catalyst composition which contains a Group VIII metal and a phosphorous bidentate ligand having the general formula $(R_1R_2P)_2R$. In the present patent application, Group VIII metals are understood as being the noble metals ruthenium, rhodium, palladium, osmium, iridium and platinum, and the iron group metals iron, cobalt and nickel. In the catalyst compositions, the Group VIII metal is preferentially chosen from palladium, nickel and cobalt. Special preference is given to palladium as a Group VIII metal. Incorporation of the Group VIII metal in the catalyst compositions is preferably effected in the form of an acetate. In addition to a Group VIII metal and a phosphorous bidentate ligand, the catalyst compositions furthermore preferably contain an anion of an acid having a pKa below 6 and in particular an anion of an acid having a pKa below 2. Examples of acids having a pKa below 2 are mineral acids such as perchloric acid, sulphonic acids such as para-toluene sulphonic acid, and halogen carboxylic acids such as trifluoro acetic acid. The anion can be introduced into the catalyst compositions either in the form of a compound from which the desired anion splits off, or in the form of a mixture of compounds from which the desired anion is formed by inter-reaction. As a rule, the anion is taken up in the catalyst compositions in the form of acid. If desired, the anion can also be incorporated in the catalyst compositions in the form of a main group metal salt or a non-noble transition metal salt of the relevant acid. Nickel perchlorate is very suitable as salt of an acid having a pKa below 2. If the choice falls on an anion of a carboxylic acid, it may be incorporated in the catalyst compositions in the form of an acid or in the form of a derivative thereof such as an alkyl or aryl ester, an amide, an imide, an anhydride, an orthoester, a lactone, a lactam or an alkylidene dicarboxylate. The anion is preferably present in the catalyst compositions in a quantity of from 1 to 100 and in particular from 2 to 50 mol per gram atom of Group VIII metal. Besides resulting from use as a separate component, the anion of an acid having a pKa below 6 can also be present in the catalyst compositions as a result of the application of, for example, palladium trifluoro acetate or palladium para-tosylate or as a Group VIII metal compound.

Besides a Group VIII metal, a phosphorous bidentate ligand and optionally an anion of an acid having a pKa below 6, the catalyst compositions preferably contain an organic oxidant as well. Examples of suitable organic oxidants are 1,2- and 1,4-quinones, aliphatic nitrites such as butyl nitrite, and aromatic nitro-compounds such as nitrobenzene and 2,4-dinitrotoluene. Preference is given to 1,4-benzoquinone and 1,4-naphthoquinone. The quantity of organic oxidant used is preferably from 5 to 5,000 and in particular from 10 to 1,000 mol per gram atom of Group VIII metal.

The phosphorous bidentate ligand is preferably present in the catalyst compositions in a quantity of from about 0.5 to 2 and in particular of from about 0.75 to 1.5 mol per gram atom of Group VIII metal. In the phosphorous bidentate ligand having the general formula $(R_1R_2P)_2R$, the groups $R_1$ and $R_2$ preferably each contain not more than 10 and in particular not more than 6 carbon atoms. Preference is given to phosphorous bidentate ligands in which the groups $R_1$ and $R_2$ are identical alkyl groups. With regard to the bridging group R present in the phosphorous bidentate ligands, preference is given to bridging groups containing three atoms in the bridge of which at least two are carbon atoms. Examples of suitable bridging groups are the $—CH_2—CH_2—CH_2$-group, the $—CH_2—C(CH_3)_2—CH_2$-group, the $—CH_2—Si(CH_3)_2—CH_2—CH_2$ group and the $—CH_2—O—CH_2$-group. A very suitable phosphorous bidentate ligand for use in the present catalyst compositions is 1,3-bis(di-n-butyl phosphino)propane.

The quantity of catalyst composition used in the preparation of the polymer can vary between wide limits. For each mol of olefin to be polymerized it is preferred to use a quantity of catalyst composition which contains $10^{-7}$ to $10^{-3}$ and in particular $10^{-6}$ to $10^{-4}$ gram atom of Group VIII metal.

In the preparation of the novel polymers, the contacting of the monomers with the catalyst composition should take place in the presence of a diluent which consists of more than 90% v of an aprotic liquid. Both polar and apolar liquids are eligible as aprotic liquids. As examples of polar aprotic liquids, mention may be made of aliphatic ketones such as acetone and methyl ethyl ketone, aliphatic carboxylic acid esters such as methyl acetate, ethyl acetate and methyl propionate, cyclic ethers such as tetrahydrofuran and dioxane, alkyl ethers of glycols such as the dimethyl ether of di-ethylene glycol, lactones such as γ-butyro lactone, lactams such as N-methyl pyrrolidone and cyclic sulphones such as sulpholane. As examples of apolar liquids, mention may be made of hydrocarbons such as n-hexane, n-heptane, cyclohexane and toluene. The diluent in which the polymerization is performed preferably contains a small quantity of a protic liquid. Lower aliphatic alcohols, particularly methanol, are very suitable for this purpose. Very favorable results were obtained by performing the polymerization in a mixture of tetrahydrofuran and methanol. If desired, the $C_{10+}$ α-olefin used as monomer can also fulfill the function of an aprotic liquid, so that the polymerization can be performed in the absence of an additional aprotic liquid such as tetrahydrofuran. An example of such a polymerization is the preparation of a carbon monoxide/n-hexadecene-1 copolymer which was performed by contacting carbon monoxide and n-hexadecene-1 with a methanolic solution of the catalyst composition.

The polymerization is preferably performed at a temperature of 25°–150° C. and a pressure of 2–150 bar and in particular at a temperature of 30°–130° C. and a pressure of 5–100 bar. The molar ratio of the olefins to carbon monoxide is preferably between 10:1 and 1:10 in particular between 5:1 and 1:5.

The following examples further describe the various aspects of this invention.

In the examples, the abbreviations used have the following meanings.

| | |
|---|---|
| CO | carbon monoxide |
| $C_{12}$ | n-dodecene-1 |
| $C_{14}$ | n-tetradecene-1 |
| $C_{16}$ | n-hexadecene-1 |
| $C_{18}$ | n-octadecene-1 |
| $C_{20}$–$C_{24}$ | mixture of linear α-olefins having 20–24 carbon atoms per molecule |

EXAMPLE 1

A $CO/C_{14}$ copolymer was prepared as follows. In a stirred autoclave with a capacity of 250 ml which contained 100 ml of tetrahydrofuran and 40 ml of $C_{14}$ in a nitrogen atmosphere, a catalyst solution was placed which contained:

| | |
|---|---|
| 5 | ml methanol, |
| 0.1 | mmol palladium acetate, |
| 0.5 | mmol nickel perchlorate, |
| 0.12 | mmol 1,3-bis(di-n-butyl phosphino)propane, and |
| 6 | mmol naphthoquinone. |

After injecting CO to a pressure of 40 bar, the contents of the autoclave were heated to 35° C. After 20 hours, the polymerization was terminated by cooling the reaction mixtures to ambient temperature and depressuring. After the addition of acetone to the reaction mixture, the polymer was filtered off, washed with acetone and dried. The yield was 40 g of $CO/C_{14}$ copolymer having an $\overline{M}_w$ of 103,000.

EXAMPLE 2

A $CO/C_{16}$ copolymer was prepared in substantially the same manner as the $CO/C_{14}$ copolymer in Example 1, but with the following differences:

a) the autoclave contained 40 ml of $C_{16}$ instead of $C_{14}$, and b) the reaction temperature was 50° C. instead of 35° C.

The yield was 35 g of $CO/C_{16}$ copolymer having an $\overline{M}_w$ of 20,000.

EXAMPLE 3

A $CO/C_{18}$ copolymer was prepared in substantially the same manner as the $CO/C_{14}$ copolymer in Example 1, but with the following differences:

a) the autoclave contained 40 ml of $C_{18}$ instead of $C_{14}$, b) the reaction temperature was 50° C. instead of 35° C., and c) the reaction duration was 30 hours instead of 20 hours.

The yield was 40 g of $CO/C_{18}$ copolymer having an $\overline{M}_w$ of 20,300.

EXAMPLE 4

A $CO/C_{14}/C_{18}$ terpolymer was prepared in substantially the same manner as the $CO/C_{14}$ copolymer in Example 1, but with the difference that the autoclave contained 30 ml of $C_{14}$ instead of 40 ml and additionally 30 ml of $C_{18}$.

The yield was 41 g of $CO/C_{14}/C_{18}$ terpolymer having an $\overline{M}_w$ of 78,000.

EXAMPLE 5

A $CO/C_{14}/C_{16}/C_{18}$ tetrapolymer was prepared in substantially the same manner as the $CO/C_{14}$ copolymer in Example 1, but with the following differences:

a) the autoclave contained 40 ml of a $C_{14}/C_{16}/C_{18}$ mixture in a molar ratio of 1:2:1 instead of $C_{14}$ alone,
b) CO was injected into the autoclave to a pressure of 70 bar instead of 40 bar,
c) the reaction temperature was 50° C. instead of 35° C., and
d) the reaction duration was 15 hours instead of 20 hours.

The yield was 42 g of $CO/C_{14}/C_{16}/C_{18}$ tetrapolymer having an $\overline{M}_w$ of 22,150.

EXAMPLE 6

A $CO/C_{20}$–$C_{24}$ polymer was prepared in substantially the same manner as the $CO/C_{14}$ copolymer in Example 1, but with the following differences:

a) the autoclave contained 40 g of $C_{20}$–$C_{24}$ instead of $C_{14}$,
b) CO was injected into the autoclave to a pressure of 70 bar instead of 40 bar,
c) the reaction temperature was 50° C. instead of 35° C., and
d) the reaction duration was 15 hours instead of 20 hours.

The yield was 38 g of $CO/C_{20}$–$C_{24}$ polymer with an $\overline{M}_w$ of 22,700.

EXAMPLE 7

A $CO/C_{14}/C_{16}/C_{18}$ pentapolymer was prepared in substantially the same manner as the $CO/C_{14}$ copolymer in Example 1, but with the following differences:

a) the autoclave contained 50 ml of a $CO/C_{14}/C_{16}/C_{18}$ mixture in a molar ratio of 1:2:2:1 instead of $C_{14}$ alone,
b) the reaction temperature was 50° C. instead of 35° C., and
c) the reaction duration was 15 hours instead of 20 hours.

The yield was 40 g of $CO/C_{14}/C_{16}/C_{18}$ pentapolymer having a $\overline{M}_w$ of 28,600.

EXAMPLE 8

A $CO/C_{14}/C_{16}/C_{18}$ pentapolymer was prepared in substantially the same manner as the $CO/C_{14}$ copolymer in Example 1, but with the following differences:

a) the autoclave contained 50 ml of a $CO/C_{14}/C_{16}/C_{18}$ mixture in a molar ratio of 2:1:1:2 instead of $C_{14}$ alone,
b) the reaction temperature was 50° C. instead of 35° C., and
c) the reaction duration was 15 hours instead of 20 hours.

The yield was 42 g of $CO/C_{14}/C_{16}/C_{18}$ pentapolymer having an $\overline{M}_w$ of 26,100.

EXAMPLE 9

A $CO/C_{16}$ copolymer was prepared in substantially the same manner as the $CO/C_{14}$ copolymer in Example 1, but with the following differences:

a) the autoclave contained 100 ml of $C_{16}$ instead of tetrahydrofuran and $C_{14}$,
b) CO was injected into the autoclave to a pressure of 70 bar instead of 40 bar,
c) the reaction temperature was 50° C. instead of 35° C., and
d) the reaction duration was 15 hours instead of 20 hours. The yield was 45 g of $CO/C_{16}$ copolymer having an $\overline{M}_w$ of 35,400.

EXAMPLE 10

The following polymers and polymer mixtures were tested as additives in three gas oils (A, B and C) in order to lower the PP, the CP and/or the CFPP of these oils.

Additive 1: $CO/C_{14}$ copolymer prepared according to Example 1
Additive 2: $CO/C_{16}$ copolymer prepared according to Example 2
Additive 3: $CO/C_{14}C_{18}$ terpolymer prepared according to Example 4
Additive 4: mixture of $CO/C_{14}$ copolymer prepared according to Example 2 and $CO/C_{16}$ copolymer prepared according to Example 2, in a weight ratio of 1:1.
Additive 5: mixture of $CO/C_{14}$ copolymer prepared according to Example 1 and $CO/C_{16}$ copolymer prepared according to Example 2, in a weight ratio of 1:3.

For the purpose of comparison, the following four additives which are commercially available were also tested.

Additive 6: PARAMIN ECA 5920
Additive 7: PARAMIN ECA 8182
Additive 8: PARAMIN ECA 8400
Additive 9: PARAFLOW 214.

The additives were introduced into the gas oils in the form of a 50% wt solution in an organic solvent. The results of the experiments are shown in Tables 1-3, where for each of the gas oils the PP, CP and/or CFPP is reported after addition of the indicated quantity of polymer solution (containing 50% wt of active material) stated as mg of polymer solution per kg of gas oil.

TABLE 1

| | | GAS OIL A | | |
|---|---|---|---|---|
| Added quantity of polymer solution, mg/kg | Additive No. | Cloud point according to ASTM D2500 °C. | Pour point according to ASTM D97 °C. | Cold filter plugging point according to IP 309 °C. |
| Gas oil A Only (Control) | | 2 | −12 | −9 |
| 100 | 6 | | | −15 |
| 200 | 6 | | | −16 |
| 300 | 6 | | | −16 |
| 400 | 6 | | | −16 |
| 600 | 6 | 0 | | |
| 1000 | 6 | −1 | | |
| 100 | 2 | | −18 | −19 |
| 200 | 2 | | −24 | |
| 600 | 2 | | −24 | |
| 1000 | 2 | 1.5 | | |
| 40 | 3 | | | −19 |
| 400 | 3 | | | −24 |
| 100 | 4 | | | −17 |
| 150 | 4 | | | −20 |
| 300 | 4 | | | −22 |
| 2000 | 5 | | −42 | |
| 2000 | 6 | | −39 | |
| 100 | 7 | 2 | −12 | |
| 200 | 7 | 2 | −15 | |
| 600 | 7 | 2 | −18 | |
| 1000 | 7 | 1 | −24 | |

TABLE 1-continued

| Added quantity of polymer solution, mg/kg | Additive No. | GAS OIL A Cloud point according to ASTM D2500 °C. | Pour point according to ASTM D97 °C. | Cold filter plugging point according to IP 309 °C. |
|---|---|---|---|---|
| 100 | 8 | 1.5 | | |
| 200 | 8 | 1.5 | | |
| 600 | 8 | 1 | | |
| 1000 | 8 | 0.5 | | |
| 100 | 9 | | −12 | −13 |
| 200 | 9 | | −15 | −18 |

TABLE 2

| Added quantity of polymer solution, mg/kg | Additive No. | GAS OIL B Cloud point according to ASTM D2500 °C. | Pour point according to ASTM D97 °C. | Cold filter plugging point according to IP 309 °C. |
|---|---|---|---|---|
| Gas oil B Only (Control) | | 1 | −15 | −9 |
| 100 | 6 | | −21 | −17 |
| 400 | 6 | | −27 | |
| 600 | 6 | | −30 | −18 |
| 4000 | 6 | | −30 | −6 |
| 100 | 2 | | −24 | −17 |
| 400 | 2 | | −30 | |
| 4000 | 2 | | −36 | |
| 100 | 4 | | −24 | |
| 4000 | 4 | | −51 | −13 |
| 200 | 3 | | | −20 |
| 400 | 3 | | | −22 |

TABLE 3

| Added quantity of polymer solution, mg/kg | Additive No. | GAS OIL C Cloud point according to ASTM D2500 °C. | Pour point according to ASTM D97 °C. | Cold filter plugging point according to IP 309 °C. |
|---|---|---|---|---|
| Gas oil C Only (Control) | | 0 | −18 | −5 |
| 75 | 6 | | | −5 |
| 300 | 6 | | | −6 |
| 150 | 2 | | | −11 |
| 150 | 1 | | | −15 |
| 300 | 1 | | | −17 |
| 150 | 4 | | | −18 |
| 75 | 3 | | | −13 |
| 600 | 3 | | −27 | |

The results reported in Tables 1 to 3 clearly demonstrate the superiority of the polymers according to the invention in terms of their capability for PP, CP and/or CFPP reduction of paraffinic hydrocarbon oils by comparison with commercially available additives for this purpose.

The $\overline{M}_w$ of the new polymers prepared according to Examples 1–9 was determined by means of GPC analysis. Using $^{13}$C-NMR analysis, it was found that these polymers were constructed of linear chains in which on the one hand the units originating from carbon monoxide and on the other hand the units originating from the $C_{10+}$ α-olefins occurred in an alternating way. In the polymers which were prepared from monomer mixtures containing two or more $C_{10+}$ α-olefins, the units originating from the various $C_{10+}$ α-olefins occurred in random sequence relative to one another.

While this invention has been described in detail for the purpose of illustration, it is not to be construed as limited thereby but is intended to cover all changes and modifications within the spirit and scope thereof.

That which is claimed is:

1. A hydrocarbon oil composition comprising a paraffinic hydrocarbon oil and at least one linear polymer of carbon monoxide with one or more α-olefins having at least 10 carbon atoms per molecule said polymer comprising of substantially alternating monomer units of carbon monoxide and olefins.

2. A composition as in claim 1 further comprising one or more $C_{9+}$ or less olefin polymer, said polymer comprising of substantially alternating monomer units of carbon monoxide and olefins.

3. A composition as in claim 1 wherein said paraffinic hydrocarbon oil is a gas oil.

4. A composition as in claim 2 wherein said paraffinic hydrocarbon oil is a gas oil.

5. A composition as in claim 1 wherein said polymers possess an average molecular weight, calculated as a mean weight $\overline{M}_w$ of between $10^3$ to $10^6$.

6. A composition as in claim 1 wherein said $C_{10+}$ α-olefin monomers are unbranched and contain fewer than 40 carbon atoms per molecule.

7. A composition as in claim 1 wherein said linear polymer(s) is selected from the group consisting of carbon monoxide/n-tetradecene-1 copolymers, carbon monoxide/n-hexadecene-1 copolymers, carbon monoxide/n-tetradecene-1/n-tetradecene-1 copolymers with carbon monoxide/n-hexadecene-1 copolymers.

8. A composition as in claim 1 wherein said linear polymer(s) is present in an amount of from about 1 to 10,000 mg of polymer per Kg of said hydrocarbon oil composition.

9. A polymer comprising of essentially linear chains of carbon monoxide with one or more $C_{10+}$ α-olefins wherein the monomer units occur in a substantially alternating manner.

10. A polymer as in claim 9 produced by the reaction of carbon monoxide/n-tetradecene-1 copolymers, carbon monoxide/n-hexadecene-1 copolymers, carbon monoxide/n-octadecene-1 copolymers, carbon monoxide/n-tetradecene-1/n-octadecene-1 terpolymers, carbon monoxide/n-tetradecene-1/n-hexadecene-1/n-octadecene-1 tetrapolymers, carbon monoxide/n-dodecene-1/n-tetradecene-1/n-hexadecene-1/n-octadecene-1 pentapolymers and polymers of carbon monoxide with a mixture of unbranched α-olefins having 20 to 24 carbon atoms per molecule.

* * * * *